US009685719B2

(12) United States Patent
Uchida et al.

(10) Patent No.: US 9,685,719 B2
(45) Date of Patent: Jun. 20, 2017

(54) PRESS-FIT TERMINAL, CONNECTOR INCORPORATING SAME, PRESS-FIT CONTINUOUS PRESS-FIT TERMINAL BODY, AND WINDING BODY OF THE CONTINUOUS PRESS-FIT TERMINAL BODY

(71) Applicant: J.S.T. Mfg. Co., Ltd., Osaka-shi (JP)

(72) Inventors: Yoshihide Uchida, Tsuyama (JP); Makoto Shiraishi, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 14/911,829

(22) PCT Filed: Jun. 25, 2014

(86) PCT No.: PCT/JP2014/066781
§ 371 (c)(1),
(2) Date: Feb. 12, 2016

(87) PCT Pub. No.: WO2015/029566
PCT Pub. Date: Mar. 5, 2015

(65) Prior Publication Data

US 2016/0197419 A1 Jul. 7, 2016

(30) Foreign Application Priority Data

Aug. 27, 2013 (JP) ..... 2013-175255

(51) Int. Cl.
*H01R 13/42* (2006.01)
*H01R 12/58* (2011.01)
*H01R 13/08* (2006.01)

(52) U.S. Cl.
CPC ..... *H01R 12/585* (2013.01); *H01R 13/08* (2013.01)

(58) Field of Classification Search
CPC ..... H01R 12/585; H01R 12/58; H01R 13/05; H01R 13/41; H05K 3/308
See application file for complete search history.

(56) References Cited

U.S. PATENT DOCUMENTS 4,769,907 A * 9/1988 Sebastien ..... H01R 12/585 29/874
4,793,817 A * 12/1988 Hiesbock ..... H01R 12/585 439/751

(Continued)

FOREIGN PATENT DOCUMENTS

DE 10-2010-024526 A1 12/2011
DE 10-2010-033079 A1 2/2012

(Continued)

OTHER PUBLICATIONS

International Search Report for International Application No. PCT/JP2014/066781 dated Aug. 12, 2014.

(Continued)

*Primary Examiner* — Hae Moon Hyeon
(74) *Attorney, Agent, or Firm* — Kratz, Quintos & Hanson, LLP

(57) ABSTRACT

A press-fit terminal (10) made of a wire material (11) of a predetermined length, the press-fit terminal includes: a distal section (12) formed at one end thereof to be inserted into a substrate (29); a connecting section (13) formed at the other end thereof to be connected to a complementary terminal; and a press-fit section (14) formed at a distal section side thereof to be press-fitted into a through-hole (30) of the substrate; wherein the press-fit section is formed at the central part thereof a hole (15) vertically elongated along an axis direction of the wire material; the hole is formed with an extending section (**14*b*) extendedly formed toward the inside of the hole along the inner circumferential surface (15*a***) of the hole; and the extending section is formed at the (Continued)

end thereof with an erected section (14*c*) in an intersecting direction about the axis direction of the wire material.

12 Claims, 9 Drawing Sheets

(56) References Cited

U.S. PATENT DOCUMENTS

| | | | | | |
|---|---|---|---|---|---|
| 4,828,514 | A * | 5/1989 | Johnson | H01R 12/585 | 439/751 |
| 4,867,710 | A * | 9/1989 | Harting | H01R 12/585 | 439/751 |
| 4,878,861 | A * | 11/1989 | Kendall | H01R 12/585 | 439/751 |
| 5,286,218 | A * | 2/1994 | Sakurai | H01R 13/5045 | 439/444 |
| 5,893,779 | A * | 4/1999 | Bianca | H01R 12/585 | 439/751 |
| 7,048,595 | B2 * | 5/2006 | Nakamura | H01R 12/585 | 439/75 |
| 2008/0119093 | A1 | 5/2008 | Bleicher | | |
| 2014/0342619 | A1 * | 11/2014 | Uchida | H01R 12/585 | 439/751 |

FOREIGN PATENT DOCUMENTS

| | | | | |
|---|---|---|---|---|
| EP | 0301730 | A2 | 2/1989 | |
| GB | 2195836 | A * | 4/1988 | H01R 12/585 |
| JP | S62-73478 | U | 5/1987 | |
| JP | S64-86464 | | 3/1989 | |
| JP | 2005-228710 | A1 | 8/2005 | |
| JP | 2007-265641 | A | 10/2007 | |
| JP | 2008-130564 | A1 | 6/2008 | |
| WO | 2013/094520 | A1 | 6/2013 | |

OTHER PUBLICATIONS

European Patent Application No. 14841222.4: Extended European Search Report dated Mar. 3, 2017.

* cited by examiner

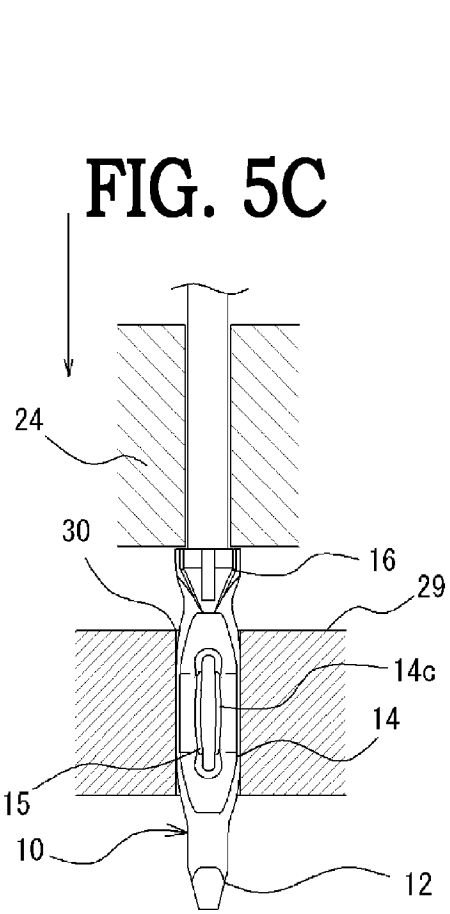
FIG. 5A
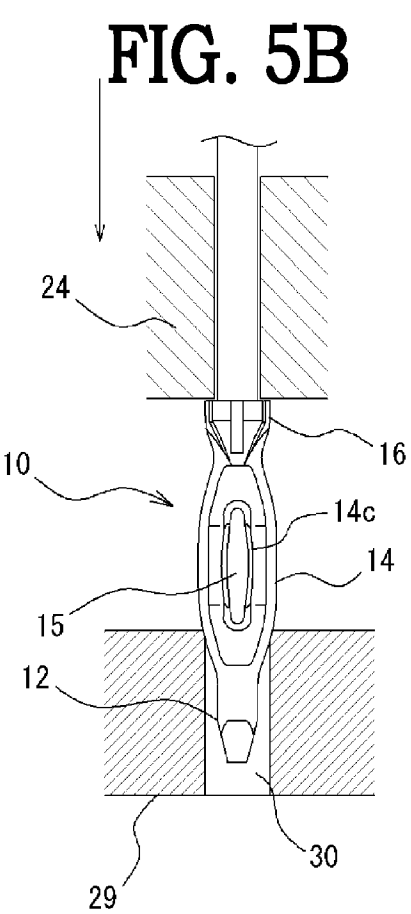
FIG. 5B
FIG. 5C

PRESS-FIT TERMINAL, CONNECTOR INCORPORATING SAME, PRESS-FIT CONTINUOUS PRESS-FIT TERMINAL BODY, AND WINDING BODY OF THE CONTINUOUS PRESS-FIT TERMINAL BODY

TECHNICAL FIELD

The present invention relates to a press-fit terminal, a connector, a continuous press-fit terminal body, and a winding body of the continuous press-fit terminal body that have a press-fit section obtaining a high retention force when it is press-fitted into a through-hole of a substrate etc.

BACKGROUND ART

Recently, a press-fit terminal has been widespread which has a press-fit section connected by its resilient force without implementing solder welding in order for connecting into a through-hole of a substrate etc. Since the press-fit terminal does not need solder welding for connecting to the substrate, thus the connection with the substrate can become easily implemented and the press-fit terminal can be repeatedly attached and detached.

Further, one type of the press-fit terminals is formed by punching a rolled plate with a pressing machine while one type of the press-fit terminals is continuously formed by making use of a wire rod. By employing the press-fit terminal formed of the wire rod, damage of the press-fit terminal can be restricted since the rolling direction of the wire rod during the manufacturing process is in along with the longitudinal direction of the press-fit terminal, thus the press-fit terminal can bear a larger pressing force during the press-fit process to the substrate than the case employing the press-fit terminal formed by punching out from the sheet material.

As a press-fit terminal manufactured from such the wire rod, for example, what is described in the following Patent Document 1 is known. The press-fit pin described in the following Patent Document 1 is a press-fit pin made of a wire material for electrical contacts and is provided with at least one shoulder portion which is integrally formed with the material of the press-fit pin.

According to the press-fit pin disclosed by the following Patent Document 1, the press-fit pin has an advantage in that the press-fit pin can be easily held at the shoulder portion by a press-fitting tool and that there is no need to hold the tip side of the press-fit pin by a press-fitting tool. Further, a force can be more easily transmitted from the press-fitting tool to the press-fit pin in a longitudinal direction without damaging the tip side of the press-fit pin.

Further, the press-fit terminal is formed with a press-fit section which is press-fitted into a through-hole formed on a substrate. This press-fit section is elastically deformed when it is press-fitted into the through-hole, thus dropout prevention is implemented by its resilient force and is connected to the substrate. At this moment, if the resilient force of the press-fit section is small, a sufficient retention force cannot be obtained, thus the connection against the substrate comes to be unreliable and defects such as a conduction failure can occur. On the other hand, if the press-fit section is made in a large size in order to enhance the retention force, it possibly occurs that the substrate is corrupted during the press-fitting. Therefore, there is a need to obtain a sufficient retention force without making the press-fit section so large.

The above Patent Document 2 discloses an invention of a press-fit terminal in which the retention force thereof is enhanced. In the invention of the press-fit terminal disclosed in the above Patent Document 2, when an opening section of the press-fit terminal is formed, a trapezoid depressions which gradually tapered from both sides in thickness direction orthogonal to the deflection direction of an elastic abutment section are press-formed so as to oppose each other by a punch and a die which are faced against each other and have trapezoidal shape in cross section. And thereafter, the bottom of the narrow thin wall part between the depressions is punched out by a press thereby a narrow slit of necessary minimum width for the deflection of the elastic abutment section is formed. According to the invention of the press-fit terminal disclosed in the following Patent Document 2, by the slit being a narrow width, since the height dimension of the elastic abutment section in its deflection direction can be sufficiently ensured, thus the reaction force of the elastic abutment section can be enhanced. Further, the press-fit terminal of the needle eye shape, in general, by ensuring the thickness of the elastic abutment section in its deflection direction, the cross-sectional secondary moment can be increased and the reaction force of the elastic abutment section can be increased, thus the retaining force in the through-hole can be enhanced.

PRIOR ART DOCUMENTS

Patent Documents

PATENT DOCUMENT 1: JP2008-130564 A
PATENT DOCUMENT 2: JP2005-228710 A

SUMMARY OF THE INVENTION

Problems to be Solved by the Invention

The invention of the press-fit terminal disclosed in the above Patent Document 2 is manufactured by punching out from a plate body. On the other hand, in the case that the press-fit terminal is manufactured with a wire material as the press-fit pin disclosed in the above Patent Document 1, it is difficult to be manufactured as the same way as the press-fit terminal disclosed in the above Patent Document 2 since the material of the part to be processed is limited comparing with the one which is manufactured by punching out from a plate body. Further, although the press-fit pin of the above Patent Document 1 is formed with a wire material, however, the retention force of the press-fit section is not described.

This invention aims to solve the such problem of the prior art, and also aims to provide a press-fit terminal having a press-fit section which is able to be formed with a limited material in order for enhancing the retention force of the press-fit section of the press-fit terminal formed with a wire material, a connector making use of the press-fit terminal, a continuous press-fit terminal body, and a winding body of the continuous press-fit terminal body.

Means for Solving the Problem

In order to solve the above problem, a press-fit terminal of the first aspect of the present invention is the press-fit terminal made of a wire material of a predetermined length, the press-fit terminal comprises:

a distal section formed at one end of the wire material to be inserted into a substrate; a connecting section formed at the other end of the wire material to be connected to a complementary terminal; and a press-fit section formed at a distal section side of the wire material to be press-fitted into a through-hole formed in the substrate; wherein the press-fit section is formed at the central part thereof a hole vertically elongated along an axis direction of the wire material;

the hole is formed with an extending section extendedly formed toward the inside of the hole along the inner circumferential surface of the hole; and the extending section is formed at the end thereof with an erected section in an intersecting direction about the axis direction of the wire material.

Further, a press-fit terminal of the second aspect of the present invention is characterized in that, in the press-fit terminal of the first aspect of the present invention, the press-fit section is formed so that the thickness of the inner circumferential surface become thinner toward the inside of the hole, and the end of the inner circumferential surface where the thickness thereof is formed to be thin is formed with the extending section and the erected section.

Further, a press-fit terminal of the third aspect of the present invention is characterized in that, in the press-fit terminal of the first or second aspect of the present invention, the press-fit section is formed with a shoulder portion at a connecting section side thereof, and the shoulder portion is provided with a shoulder end portion formed in a size which is able to be pressed by a jig and so as to adjoin the connecting section side of the press-fit section.

Further, a press-fit terminal of the fourth aspect of the present invention is characterized in that, in the press-fit terminal of the third aspect of the present invention, the shoulder portion is formed with a reinforcement part along the axis direction of the wire material.

Further, a press-fit terminal of the fifth aspect of the present invention is characterized in that, in the press-fit terminal of the fourth aspect of the present invention, the reinforcement part is formed in a projected shape extending along the axis direction of the wire material.

Further, a press-fit terminal of the sixth aspect of the present invention is characterized in that, in the press-fit terminal of the fifth aspect of the present invention, the shoulder portion is formed with another reinforcement part extending from an end of a laterally protruded portion of the wire material in a direction orthogonal to the lateral direction.

Further, a press-fit terminal of the seventh aspect of the present invention is characterized in that, in the press-fit terminal of any one of the third to the sixth aspect of the present invention, a joining portion for joining the shoulder portion with the press-fit section is integrally formed with the shoulder portion and the press-fit section between the shoulder portion and the press-fit section.

Further, a press-fit terminal of the eighth aspect of the present invention is characterized in that, in the press-fit terminal of the seventh aspect of the present invention, the reinforcement part is formed so as to reach the joining portion from the shoulder portion.

Further, a press-fit terminal of the ninth aspect of the present invention is characterized in that, in the press-fit terminal of any one of the first to the eighth aspect of the present invention, the distal section and the connecting section are formed with tapers tapering off towards the ends thereof, and an end surface of the distal end and an end surface of the connecting section have cross sections which are twisted and cut off.

A connector of the one aspect of the present invention is formed of insulated material and having a housing with a plurality of openings; and the press-fit terminals of any one of the first to ninth aspect of the present invention are installed into the plurality of openings.

A continuous press-fit terminal body of one aspect of the present invention is characterized in that the press-fit terminals of any one of the first to ninth aspect of the present invention is continuously formed in a wire material, and the distal section of one press-fit terminal and the connecting section of another press-fit terminal are coupled together.

A winding body of the continuous press-fit terminal body of one aspect of the present invention is characterized in that the continuous press-fit terminal body of the present invention is wound in a circular shape.

Advantageous Effect of Invention

According to the press-fit terminal of the first aspect of the present invention, it is possible to form the cross sectional area of the press-fit section in a large size and to form the press-fit section having a high retention force.

Further, according to the press-fit terminal of the second aspect of the present invention, it is possible to form the press-fit section by making efficient use of material of the wire material.

Further, according to the press-fit terminal of the third aspect of the present invention, since the press-fit terminal is provided with the shoulder portion and the shoulder portion is formed so as to adjoin the press-fit terminal, thus the distance between the shoulder portion to be pressed by the jig and the surface of the substrate to which the press-fit terminal is inserted can be shortened, and the press-fit terminal is possible to be inserted so as to move along the central axis of the through-hole, thereby it is possible to prevent the substrate from damaging and the contact from corruption, and to obtain a stable insertion and retention force. Further, it is possible for the shoulder portion of the press-fit terminal to receive the pressing force from the jig without any loss, thus the insertion process to the substrate can be smoothly implemented. Further, since the shoulder end portion is formed so as to adjoin the press-fit section, thus the distance between the shoulder end portion and the surface of the substrate can be further shortened, thereby when the press-fit terminal is inserted into the substrate, the press-fit terminal is possible to be straightly inserted so as to move along the central axis of the hole of the substrate with a higher precision, thus the reliability and the stability of insertion can be enhanced, and the retention force of the terminal within the substrate can be also ensured.

According to the press-fit terminal of the fourth aspect of the present invention, it is possible to strengthen the press-fit section against the force in the axis direction exerting onto the shoulder portion, thus the deformation and the damage of the shoulder portion can be inhibited when it is pressed by the jig.

Further, according to the press-fit terminal of the fifth aspect of the present invention, it is possible to form the first firm reinforcement part by making efficient use of material of the wire material by which the shoulder portion is formed.

According to the press-fit terminal of the sixth aspect of the present invention, since the second reinforcement part is formed, thus not only the shoulder portion itself can be strengthened but also the area to be pressed by the jig can be enlarged, thereby the reliability and the stability of insertion of the press-fit terminal into the substrate can be enhanced.

According to the press-fit terminal of the seventh aspect of the present invention, since the joining portion is integrally formed between the shoulder portion and the press-fit section, the strength can be enhanced rather than the case in which the portion between the press-fit section and the shoulder portion is independently formed in the wire material. Further, since the press-fit section and the shoulder portion can be more closely adjoined and be integrally formed, thus the portion between the shoulder portion and the press-fit section can be inhibited from deformation when the shoulder portion is pressed and be strengthened. As for the thickness of the joining portion, it is preferable that when the cross sectional area of the joining portion is S and the cross sectional area of the wire material is A, the cross sectional area S of the joining portion is in range of: $A \geq S \geq 0.9$ A. In this way, it is possible to form the joining portion in the same thickness or approximately the same thickness with the thickness of the wire material at the cross section thereof, thus the joining portion can be formed to have more strength.

Further, according to the press-fit terminal of the eighth aspect of the present invention, since the portion joining the shoulder portion with the joining portion can be formed to have a strength, thus the buckling etc. can be further inhibited.

Further, according to the press-fit terminal of the ninth aspect of the present invention, since the press-fit terminal is cut by twisting when it is divided from the state of the wire material into one respective members, the end of the distal section and the end of the connecting section of the press-fit terminal thus exhibit cutting surfaces with spiral shapes, the burrs which are generated by sliced cut can be inhibited.

According to the connector of one aspect of the present invention, the connector in which the press-fit terminal which exhibits the effect of any of the above first through ninth aspect of the present invention can be obtained.

According to the continuous press-fit terminal body of one aspect of the present invention, the continuous press-fit terminal body in which the press-fit terminals exhibiting the effect of any of the above first through ninth aspect of the present invention are continuously formed is obtained. Since tapers which taper off toward the potion joining the distal section with the connecting section are formed so that the joined portion is the thinnest, thus when the continuous press-fit terminal body is twisted cut and divided into the press-fit terminals, the body can be easily divided at the joined portion and generation of burrs can be further inhibited.

According to the winding body of the continuous press-fit terminal body of one aspect of the present invention, the elongated continuous press-fit terminal body is formed as the winding body, thus conveyance and storage thereof can be easily and efficiently implemented. When the winding body of the continuous press-fit terminal body is formed, the body also can be wound around a cylindrical member to be a core such as a roil and a bobbin. In this way, conveyance and storage of the winding body of the continuous press-fit terminal body can be easily and efficiently implemented.

BRIEF DESCRIPTION OF THE DRAWINGS

FIG. 5A shows the press-fit terminal of the embodiment in a state before the installation; FIG. 5B shows the press-fit terminal in a state during the installation; and FIG. 5C shows the press-fit terminal in a state after the installation.

EXEMPLARY EMBODIMENT OF THE INVENTION

Figures 1A, 1B, 1C, 1D:
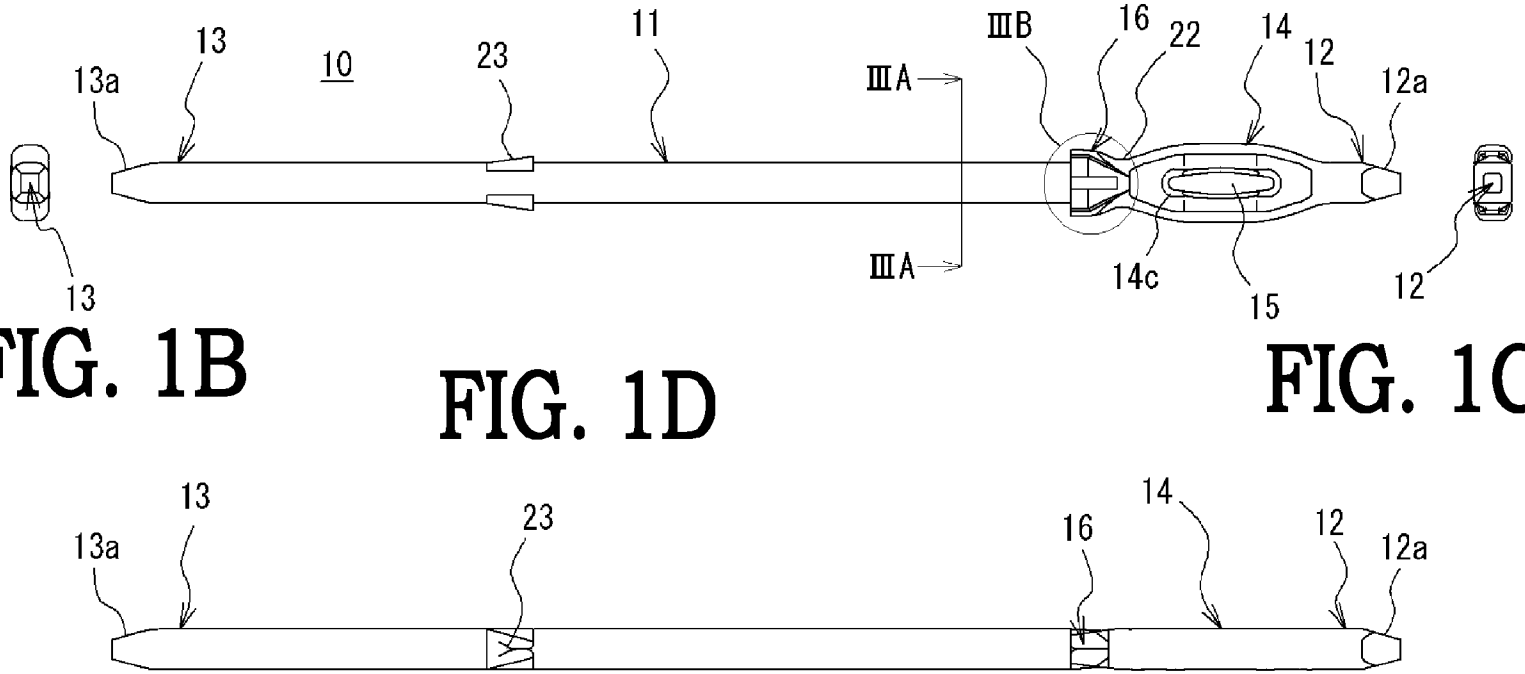
FIG. 1A shows a top plan view of the press-fit terminal according to the embodiment.
FIG. 1B shows a rear view thereof.
FIG. 1C shows a front view thereof.
FIG. 1D shows a side view thereof.

An embodiment of the present invention will be described hereinafter with referring to the drawings. The following embodiment is to exemplify a press-fit terminal, a connector making use thereof, a continuous press-fit terminal body, and a winding body of the continuous press-fit terminal body for embodying the technical concept of the present invention, and is not intended to limit the present invention into the above but can also be equally applicable to other embodiments within the scope of the claims.

[First Embodiment]

Now, a press-fit terminal according to the embodiment of the present invention will be explained with reference to FIGS. 1 to 4. The press-fit terminal 10 according to the first embodiment of the present invention (hereinafter referred to as "PF terminal") is formed into one respective PF terminal by applying against an elongated wire material 11A a shape of the PF terminal through a press processing etc. in a predetermined interval (refer to FIGS. 8A and 8B) and thereafter, by dividing it into a wire material 11 of the predetermined length. The PF terminal 10 is formed with a distal section 12 to be inserted into a substrate at one end of the wire terminal 11, and with a connecting section 13 to be connected with a complementary terminal at the other end. Further, a press-fit section 14 (hereinafter referred to as "PF section") to be press-fitted into the substrate is formed at the distal section 12 side of the wire material 11, and the upper section of the PF section 14, i.e. the side at which the connecting section 13 is formed, is formed with a shoulder portion 16 so as to adjoin the PF section 14.

The wire material 11 is obtained by: forming the elongated wire material 11A (refer FIGS. 8A and 8B) by rolling and extending stainless steel, iron-nickel alloy, copper, and copper-based alloy and applying a plating process; and thereafter dividing it into a predetermined length. When the elongated wire material is formed, the shapes of the PF terminals are also continuously formed (refer FIGS. 8A and 8B). Since the PF terminal 10 is formed from the wire material, the press-fit terminal has a strength against a force in the axis direction, thus damage of the distal section by the pressing force during the press-fit process can be inhibited. Further, the PF terminal of the embodiment has a square shape with chamfered corners in its cross section (refer FIG. 3A). However, the PF terminal is not limited to the above shape but can be a shape such as circular, elliptical, and rectangular shape in its cross section which can form a wire material. The structure of the PF terminal will be explained hereinafter.

The distal section 12 is a section which precisely guides the PF terminal 10 into a specified through-hole when the PF terminal 10 is installed into the through-hole of the substrate etc. Therefore, the distal section 12 is formed with a taper 12*a* tapering off towards the end in order to easily insert into the through-hole.

The connecting section 13 is a section to be connected with the complementary terminal. Therefore, the connecting section 13 can be formed as any shape corresponding to the complementary terminal. The connecting section 13 of the embodiment is formed with a taper 13*a* tapering off towards the end as the same as the distal section 12.

Figure 8A:
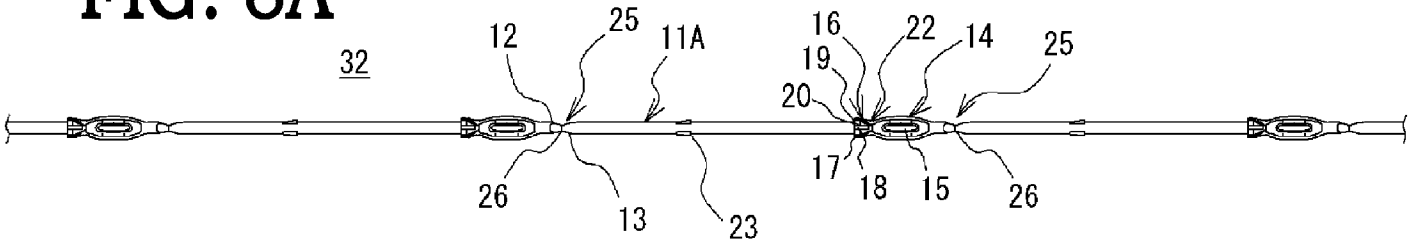
FIG. 8A shows a top plan view of one part of a continuous press-fit terminal body.
Figure 8B:
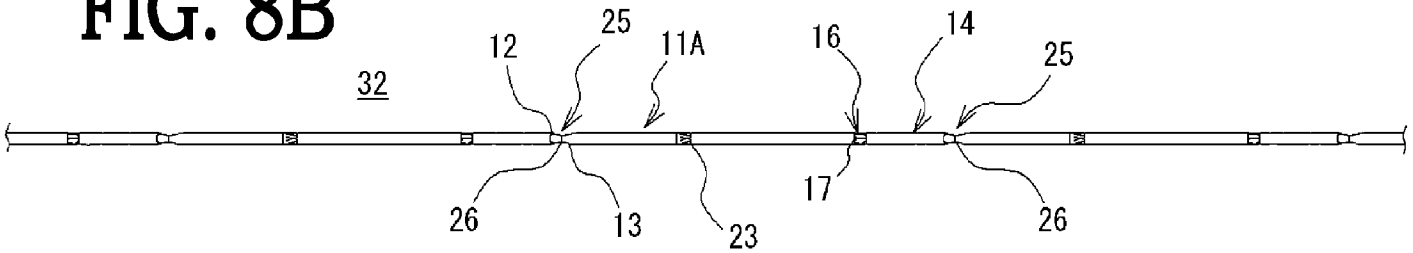
FIG. 8B shows a side view.
Figure 8C:
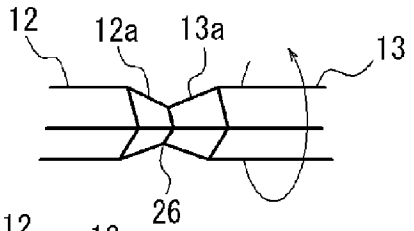
FIGS. 8C and 8D show enlarged views explaining a dividing process of the continuous press-fit terminal body.
Figure 8D:
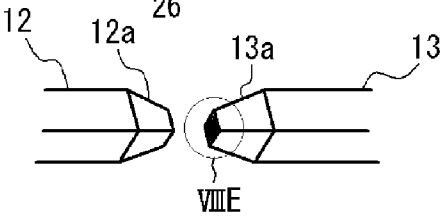
Figure 8E:
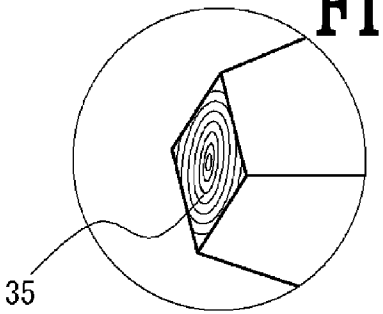
FIG. 8E shows an enlarged view of VIIIE portion in FIG. 8D.

The end surfaces of the distal section 12 and the connecting section 13 are cutting planes with vortex (refer FIG. 8E). These vortex shapes are formed by rotating a press-fit terminal to be divided from a press-fit terminal of the wire material side and dividing so as to make a twist cut when the press-fit terminals continuously formed in the elongated wire material 11A are divided. Therefore, generation of burrs caused by shearing etc. can be inhibited.

Further, the distal section 12 and the connecting section 13 can be provided with a gold plating in order for enhancing the conductivity. At this moment, the gold plating can be applied to both of or to any one of the distal section 12 and the connecting section 13.

Figure 2A:
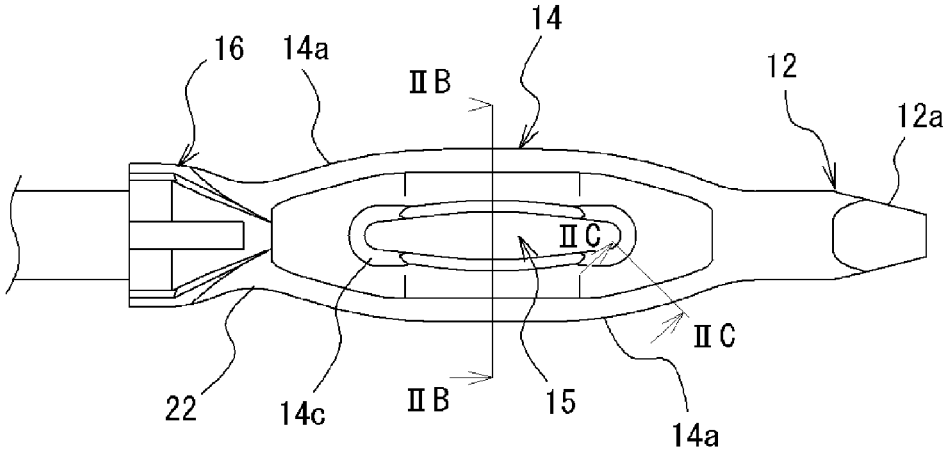
FIG. 2A shows an enlarged view of the press-fit section.

The PF section 14, as shown in FIG. 2A, is formed at the distal end 12 side of the wire material 11, and is formed with a vertically elongated hole 15 at the central part of the wire material 11. The PF section 14 is formed so as to symmetrically protrude toward the directions of the side surfaces of the hole 15 and to have a width wider than the width of the wire material 11. Further, the PF section 14 is formed so that the side surface section 14*a* to be press-fitted into the through-hole has almost the same thickness as the wire material. Further, the side surface section 14*a* of the PF section 14 is formed so as to become thinner toward the hole 15. By forming the hole 15, PF section 14 can be elastically deformed. The PF section 14 is formed so as to adjoin the shoulder portion described below.

Figure 2B:
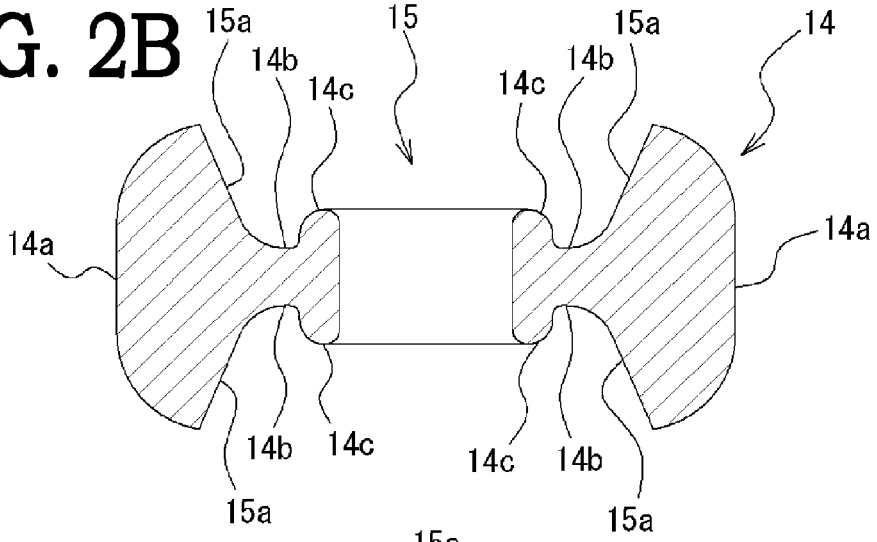
FIG. 2B shows a cross-sectional view at IIB-IIB line in FIG. 2A.

Further, as shown in FIG. 2B, an inner circumferential surface 15*a* of the hole 15 of the PB section 14 is formed with an extended section 14*b* protruding toward the inside of the hole 15. And this extended section 14*b* is integrally formed at its end with an erected section 14*c* which protrudes and encircles the hole 15 with a predetermined height. This erected section 14*c* is formed so as to protrude at the both surface sides of the hole 15 in a vertical direction with respect to the axis direction of the wire material 11.

Further, the PF section 14, as shown in FIG. 2B, is formed so as to become thinner toward the hole 15. And the extended section 14*b* is extendedly formed from the end of the inner circumferential surface 15*a* of the hole 15 which is formed as thin and the erected section 14*c* is further formed at the distal end of the extended section 14*b*. It is desirable that the erected section 14*c* is formed so that the thigh thereof is within an extent of the thickness of the side surface section 14*a* of the PF section 14. The erected section can be formed to have an arbitrary thickness.

The inner circumferential surface 15*a* of the PF section 14 is formed so as to become thinner toward the inside of the hole 15. However, this invention is not limited to the above. The inner circumferential surface of the hole can also be formed to be an even plane. In this case, the hole is formed with the extended section and the erected section at its inner circumferential surface which is formed to be an even plane.

Figure 2C:
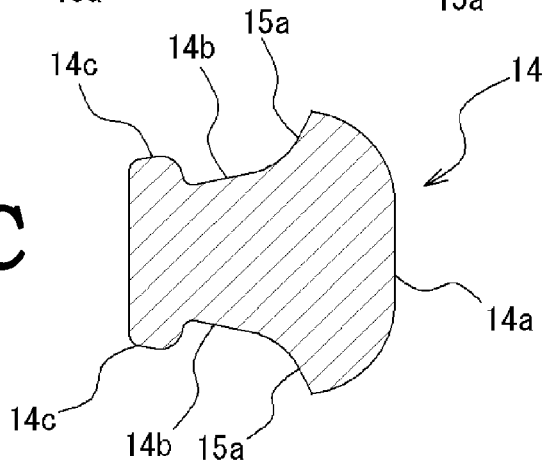
FIG. 2C shows a cross-sectional view at IIC-IIC line in FIG. 2C.
Figure 3B:
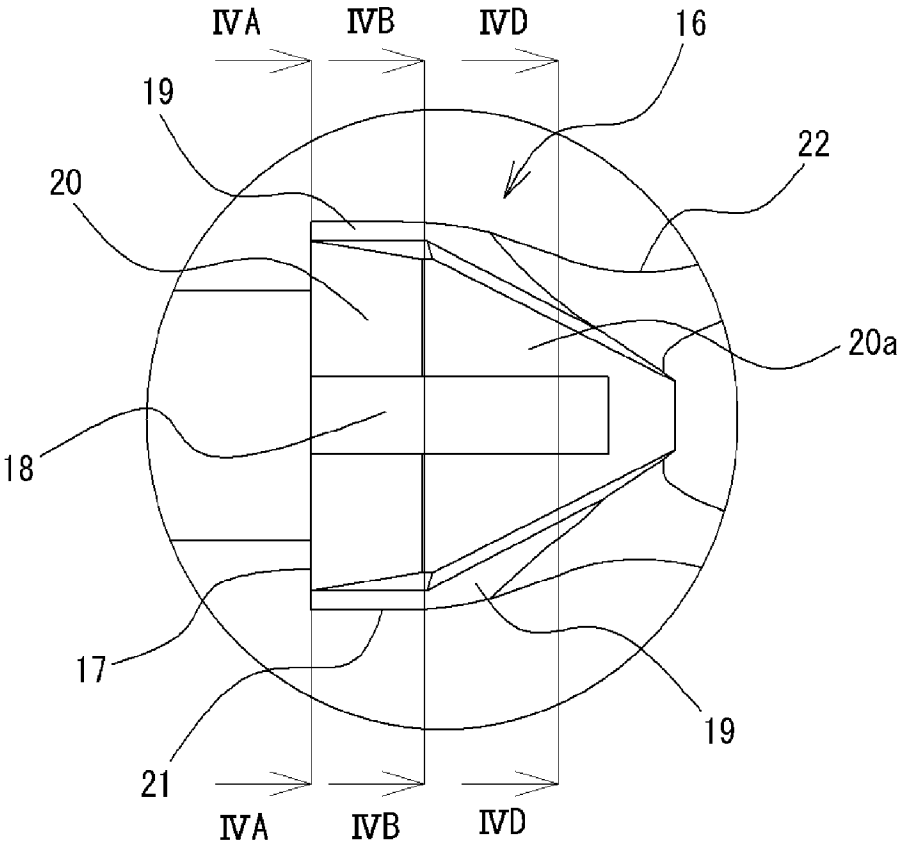
FIG. 3B shows an enlarged view of IIIB portion in FIG. 1A
Figure 3A:
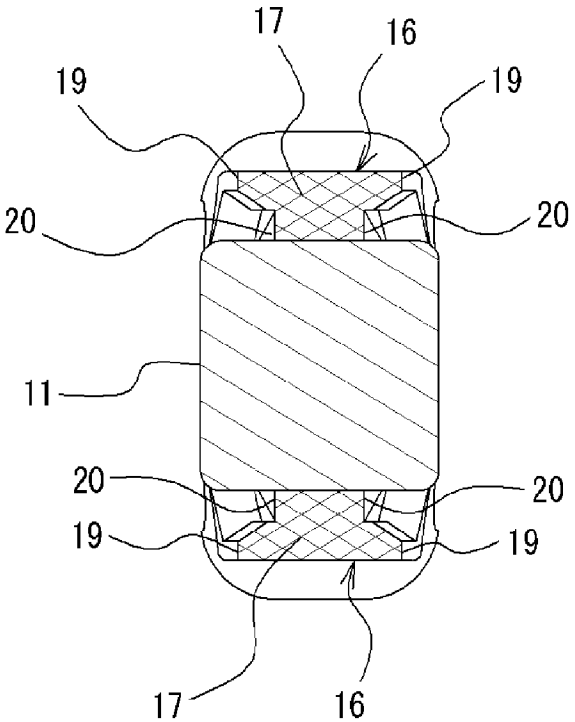
FIG. 3A shows a cross-sectional view at IIIA-IIIA line in FIG. 1A.

Thus, by forming the erected section 14*c* at the hole 15 of the PF section 14, since the cross-sectional area of the PF section can be enlarged and the cross-sectional secondary moment also can be increased, therefore, the retention force of the PF section when it is press-fitted into the through-hole can be enhanced. Further, as shown in FIG. 2C, since the end of the hole 15 in the axis direction of the PF section 14 can draw more material from the wire material 11, thus the portion between the outside section of the PF section 14 and the erected section 14*c* can be formed to be thick comparing with the other portion. In this way, since the cross-sectional area of this portion can be enlarged, and the cross-sectional secondary moment also can be increased, thus a high retention force can be obtained.

Although if the width of the erected section 14*c* is made to thick, the cross-sectional area is enlarged and thus the retention force is also increased, however, since the material for the erected section needs to be brought from the side surface section 14*a* etc. of the PF section 14, it is desirable to set a width which is selected by considering the whole cross-sectional area of the PF section 14.

Further, the extent of the PF section 14 in the transverse direction can be adjusted according to the diameter of the through-hole formed in the substrate into which the PF section is inserted, and the extent of the PF section 14 is set to be larger than the diameter of the through-hole. In this way, when the PF terminal is inserted into the substrate, the PF section is elastically deformed by the pressure exerted by the through-hole of the substrate, and the PF section is secured into and connected to the through-hole by the resilient force generated by the elastic deformation.

When the PF section 14 is formed, by not only forming the hole 15 only in the PF section 14 but also by forming the outer surface of the PF section with the same thickness as the wire material and further forming the PF section so as to become thinner toward the hole of the PF section, thus the PF section having a high strength can be efficiently formed without forming the hole in a large size.

Further, it may be possible for the PF section 14 to be alloyed, and thus the peeling off of the plating at the time of the insertion into the through-hole can be inhibited by alloying the PF section 14. This alloying can be implemented by irradiating a laser to the PF section 14.

The shoulder portion 16 will be explained hereinafter. The shoulder portion 16 is formed so as to symmetrically protrude about the axis line of the wire material 11 toward the same direction with the direction to which the PF section 14 laterally protrudes. This shoulder portion 16 is the portion on which the pressing force is exerted by a jig etc. when the PF terminal 10 is press-fitted into the substrate and is formed so as to adjoin the above mentioned PF section 14. Further, the shoulder portion 16 is provided with a shoulder end portion 17 which is pressed by the jig etc; and the shoulder end portion 17 is formed in a size (area) which enable to be pressed by the jig etc. Further, the shoulder portion 16, since it is formed so as to adjoin the PF section 14, thus the distance between the shoulder end portion 17 which is pressed by the jig and the surface of the substrate become closer comparing with the conventional one.

Thus, since the shoulder portion 16 is formed so as to adjoin the PF terminal 10, the distance between the shoulder portion to be pressed by the jig and the surface of the substrate to which the press-fit terminal is inserted can be shortened, thereby the press-fit terminal is possible to be inserted so as to straightly move along the central axis of the hole of the substrate with a high precision, thus the reliability and the stability of insertion can be enhanced, and the retention force of the terminal within the substrate can be also sufficiently ensured.

Further, the shape of the shoulder portion 16 is formed in an approximately hexagonal shape so that the width L at the shoulder end portion 17 is the widest, and this section of width L is elongated a little, and the section of the shoulder portion 16 adjoining the PF section 14 is the narrowest. Since the wire material 11 is pressed to stretch toward the lateral direction when the shoulder portion 16 is formed, thus the shoulder portion 16 is formed with a rolled section 20 which stretches thinner than the cross section of the wire material 11. However, since the rolled section 20, only by itself, cannot maintain the strength of the shoulder portion 16, thus, in order to obtain the needed strength, the shoulder portion 16 is formed integrally with a first reinforcement part 18 and a second reinforcement part 19.

The first reinforcement part 18 is formed as a projected rib at the center portion of the shoulder portion 16 along the axis direction of the wire material 11. Thus the shoulder portion 16 is formed with the first reinforcement part 18 along the axis direction of the wire material 11, thereby the shoulder portion 16 can be strengthened against the force in the axis direction exerted thereto. This first reinforcement part 18 is formed so as to reach the joining portion 22 which is explained later (refer FIG. 3B). Further, the second reinforcement part 19 is formed so that the portion which is the end portion of the rolled section 20 laterally protruding in the shoulder portion 16 is extended toward the orthogonal direction about the lateral direction thereof. The second reinforcement part 19 is formed so that its cross section is T-shape. Since the second reinforcement part 19 is formed in this way, thus not only the shoulder portion itself can be strengthened but also a larger area to be pressed by the jig etc. can be obtained.

Figure 4A:
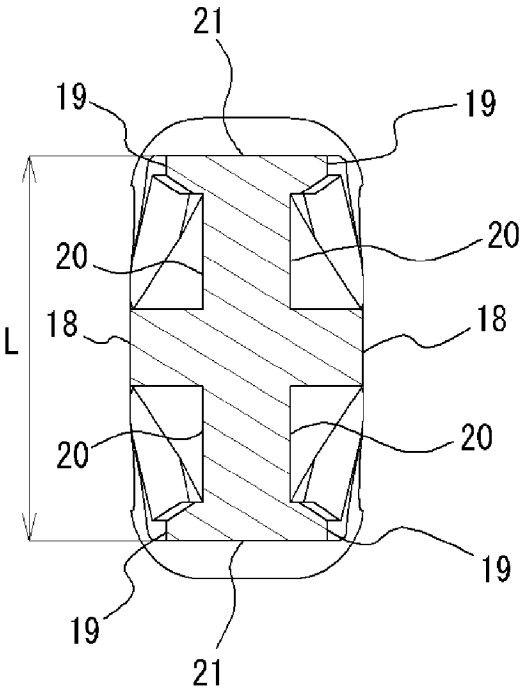
FIG. 4A shows a cross-sectional view at IVA-IVA line in FIG. 3A.
Figure 4B:
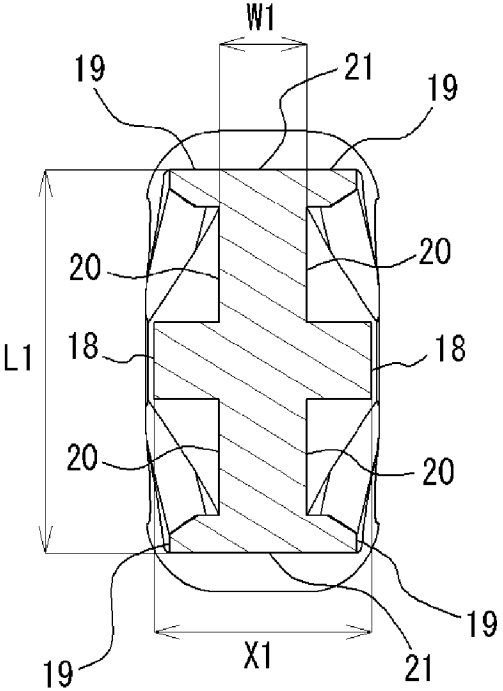
FIG. 4B shows a cross-sectional view at IVB-IVB line in FIG. 3A.
Figure 4C:
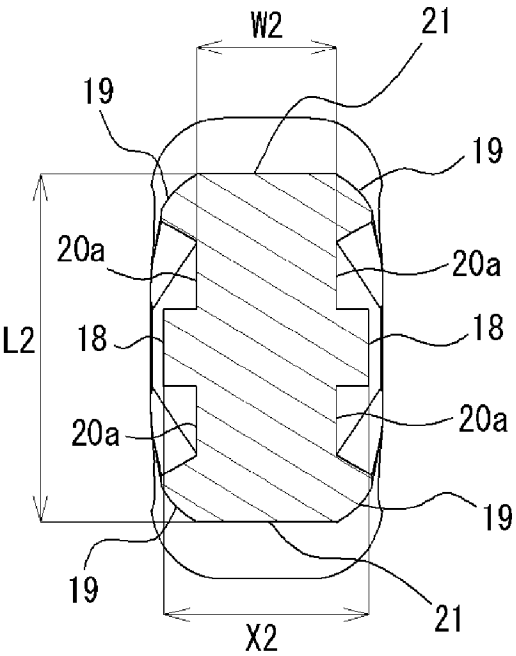
FIG. 4C shows a cross-sectional view at IVC-IVC line in FIG. 3A.

Further, the rolled section 20 is formed with a slant 20*a* toward the direction so that the shape of the shoulder portion 16 is narrowed. The slant 20*a* is formed so that the protrusion toward the lateral direction decreases while the thickness of the rolled section 20 increases. More particularly, comparing FIG. 4B with FIG. 4C of which the cutting positions are different, it is found that the relationship between the portion protruding toward the lateral direction in FIG. 4B having width W1 and the corresponding portion in FIG. 4C having width W2 is expressed by W1<W2. Further, the relationship between the width X1 of the first reinforcement part in FIG. 4B and the width X2 of the same member in FIG. 4C is expressed by X1>X2. Further, the relationship between the width L1 of the second reinforcement part in FIG. 4B and the width L2 of the same member in FIG. 4C is expressed by L1>L2.

Since the second reinforcement part 19 is formed along the shape of an exterior surface 21 of the shoulder portion 16, thus the shoulder portion is formed to have more strength. Although the narrowed portion of the shoulder portion 16 is exerted with a large force and is easy to deform due to the pressing force exerted on the shoulder end portion 17 of the shoulder portion 16 being transmitted to the axis direction of the PF terminal 10, however, the narrowed portion is strengthened by forming the first reinforcement part 18 and the second reinforcement part 19 and thus the destruction and the damage can be restricted.

Further, the joining portion 22 is formed between the PF section 14 and the shoulder portion 16. This joining portion 22 is integrally formed with the PF section 14 and the shoulder portion 16, and the portion which connects the portion continuing from the narrowed portion of the shoulder portion 16 and the PF section 14. This joining portion 22 is formed so that the cross sectional area of the joining portion 22 is the same or approximately the same as the cross sectional area of the wire material 11, thereby a high strength can be obtained. More particularly, it is preferable that when the cross sectional area of the joining portion is S and the cross sectional area of the wire material 11 is A, the cross sectional area S of the joining portion 22 is in range of: $A \geq S \geq 0.9A$. Further, the joining portion 22, since the PF section 14 and the shoulder portion 16 are integrally formed, thus can obtain a high strength, and the PF section 14 and the shoulder portion 16 can be more closely formed, thereby the distance between the shoulder portion 16 and the surface of the substrate can be shortened.

Thus, by forming the first reinforcement part 18 and the second reinforcement part 19 on the shoulder portion 16, the reliability and the stability of inserting the PF terminal 10 into the substrate can be enhanced, and also the deformation and the damage of the shoulder portion can be inhibited when it is pressed by the jig. Further, the joining portion 22 is extendedly formed with the first reinforcement part 18 which is formed on the shoulder portion 16. Thus, since the first reinforcement part 18 is formed over the portion connecting the shoulder portion 16 with the joining portion 22, the PF terminal can be formed to have more strength, and the buckling etc. can be inhibited. Further, by forming the joining portion which is narrower than the shoulder portion and the press-fit section between the shoulder portion and the press-fit section, since the press-fit section at the joining portion side can be narrowed, thus the press-fit section can obtain a sufficient resilient force comparing with the case in which the press-fit section is directly formed from the width of the shoulder portion.

The shape of the shoulder portion of the PF terminal is not limited to the approximately hexagonal shape but can be any shape which has a size to be pressed by the jig etc. at the shoulder end portion and in which the section adjoining the PF section 14 is narrower than the width of the shoulder end portion; and is formed as, for example, a triangle shape, a semicircular shape and a semi-elliptic shape which are constituted by curved lines, a hexagonal shape and a gourd shape which may have portions protruding beyond the shoulder end portion, and any shapes similar to these shapes. In any of these shapes, it is possible to form the first reinforcement part and the second reinforcement part etc, and to also form the joining portion between the PF section and the shoulder portion, thus the advantageous effect of the invention described above can be achieved.

Further, a press-fitting section 23 is formed at the connecting section 13 side of the PF terminal 10. This press-fitting section 23 is press-fitted into the housing and is the portion for dropout prevention. Therefore, the press-fitting section 23 is formed into any size and shape corresponding the housing to be used.

Next, installation of the PF terminal of the embodiment onto the substrate will be explained with reference to FIG. 5. At first, in order to install the PF terminal 10 onto the substrate 29, the PF terminal is located so as to correspond to the through-hole 30 formed in the substrate 29 (refer FIG. 5A). Then, the distal section 12 of the PF terminal 10 is matched with and inserted into the through-hole 30 until the PF section 14 abuts against the through-hole 14 (FIG. 5B). Since the PF section 14 is formed larger than the diameter of the through-hole 30, a force as large as deforming the PF section 14 is required in order to insert the PF section 14 into the through-hole 30. Therefore, the PF terminal 10 is pressed by making use of the jig 24 to implement the insertion. At this moment, the jig 24 abuts against and presses the shoulder portion 16 formed in the PF terminal 10, thus the PF section 14 is deformed and press-fitted into the through-hole 30.

This press-fitting process is implemented up to reaching the predetermined position, thus the PF terminal is secured and connected due to the resilient force generated by deformation of the PF section 14 (refer FIG. 5C). At this moment, since the erected section 14*c* is formed around the hole 15 of the PF section 14 in an erected manner, thus the sectional area of the PF section 14 can be enlarged (refer FIG. 2A), and cross-sectional secondary moment also can be increased, therefore, a high retention force can be obtained. Although the case in which there is one PF terminal 10 is explained in FIG. 5, however, a plurality of PF terminals also can be connected to a plurality of through-holes, respectively. In that case, the PF terminals can be connected not only one by one but also as a group including the plurality of PF terminals at one time.

APPLICATION EXAMPLE 1

Figure 6A:
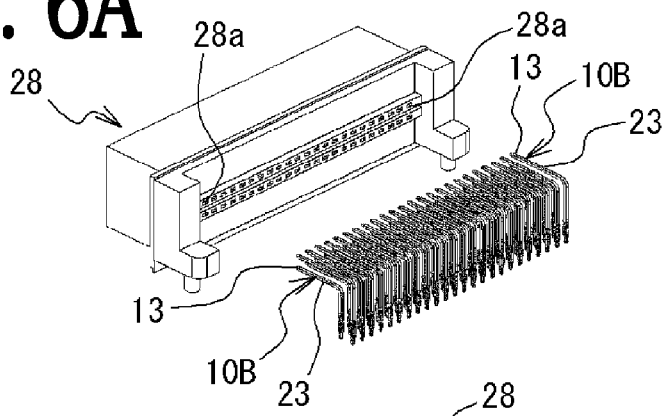
FIG. 6A shows a perspective view of one embodiment of usage of the press-fit terminals of the embodiment.
Figure 6B:
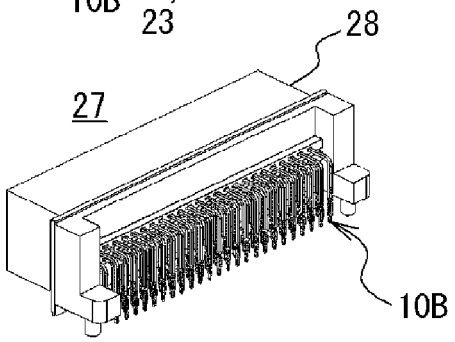
FIG. 6B shows a perspective view of a state continuing from FIG. 6A.

A connector 17 making use of the PF terminal 10 will be explained hereinafter as the application example 1 of the embodiment of usage of the PF terminal of the embodiment. First of all, as shown in FIG. 6A, a plurality of PF terminals 10B bent into substantially a right angle at the middle portion of the PF terminals which are linearly formed are prepared. A housing 28 made of synthetic resin in which a plurality of through-holes 28*a* are formed with the same number of PF terminals 10B is prepared, and the connecting section 13 side or predetermined portion of the plurality of PF terminals 10B are inserted into the through-holes 28*a* of the housing 28.

At this moment, the press-fitting sections 23 formed at the connection sections 13 side of the PF terminals 10B are press-fitted into the through-holes 28*a* of the housing 28, thus the dropout prevention is implemented. This insertion to the housing 28 can not only implemented one by one but also implemented as a group including the plurality of PF terminals at one time. The assembling process of the connector 27 being provided with the PF terminals 10B is now finished. In this way, the connector being provided with the PF terminals according to the embodiment can be formed. Since the housing to which the PF terminals are installed can be a variety of shapes and be selected in harmonized with the embodiment of usage of the connector, thus the connector with a wide versatility can be obtained.

Figure 6C:
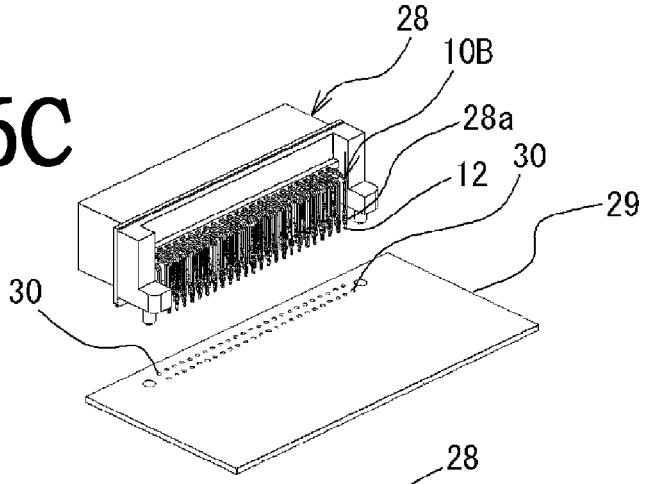
FIG. 6C shows a perspective view of a state continuing from FIG. 6B.
Figure 6D:
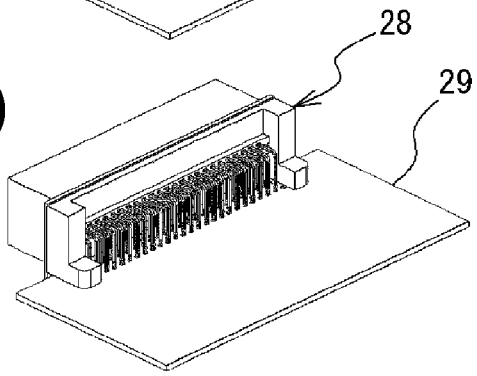
FIG. 6D shows a perspective view of a state continuing from FIG. 6C.

Then, the finished connector 27 is connected to the substrate 29. As shown in FIG. 6C, the connector 27 is aligned with the substrate 29 in which the plurality of through-holes 30 corresponding to the number of the plurality of PF terminals 10B installed into the connector 27, then the distal sections 12 of the respective PF terminals 10B are inserted into the each thorough-hole 30. And the PF sections 14 of the PF terminals 10 are press-fitted into the through-holes 30 by making use of jig etc, and the connection of the connector 27 to the substrate is completed by implementing the press-fitting process at the every predetermined position (refer FIG. 6D).

APPLICATION EXAMPLE 2

Figure 7A:
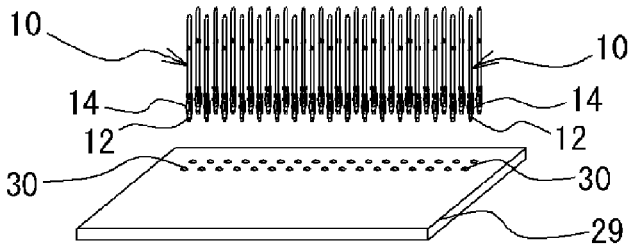
FIG. 7A shows a perspective view of another embodiment of usage of the press-fit terminals of the embodiment.
Figure 7B:
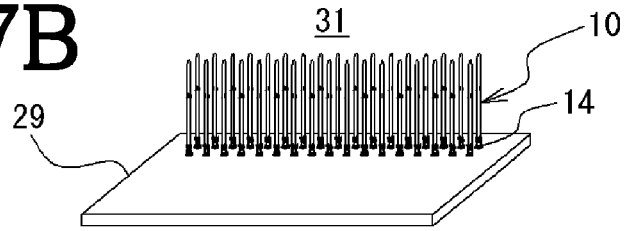
FIG. 7B shows a perspective view of a state continuing from FIG. 7A.

An Application Example 2 of the embodiment of another usage of the PF terminals 10 will be further explained. As the Application Example 2, first of all, a plurality of the same PF terminals 10 as the embodiment are connected to the through-holes 30 of the substrate. This connection is implemented by aligning the plurality of PF terminals 10 with the plurality of through-holes 30 formed in the substrate 29 (refer FIG. 7A). Then, the plurality of PF terminals 10 is press-fitted into the through-hole 30 by making use of jig etc. thereby the connection is implemented (refer FIG. 7B). A linearly shape is used as the PF terminal 10 in the Application Example 2, however, a bent structure also can be used for the PF terminal. Further, the PF terminals 10 are connected to the substrate 19 to form a unit 31, and the unit 31 can be distributed.

Figure 7C:
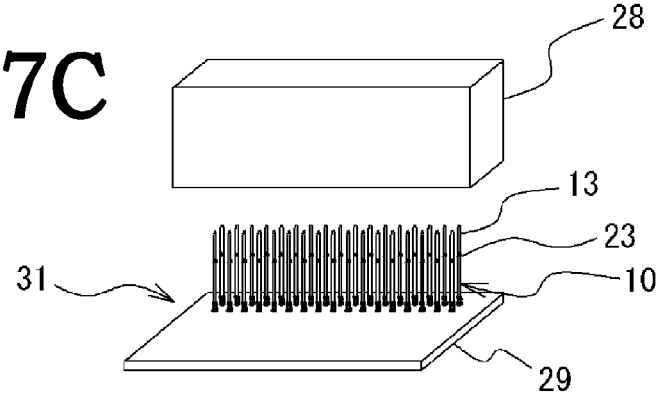
FIG. 7C shows a perspective view of a state continuing from FIG. 7B.
Figure 7D:
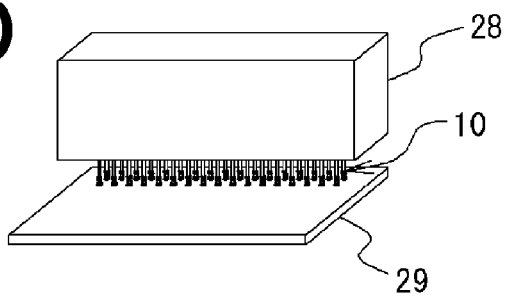
FIG. 7D shows a perspective view of a state continuing from FIG. 7C.

Then, the unit 31 in which the PF terminals 10 are connected to the substrate 29 is connected with a housing 28A (refer FIG. 7C). This installation to the housing 28A is implemented by inserting the connecting sections 13 of the PF terminals 10 into the through-holes (not shown) formed in the housing 28 and thereafter by press-fitting the press-fitting section 23 thereinto (refer FIG. 7D). The installation of the PF terminals 10 into the housing 28 is thus implemented. In this way, the PF terminals can be widely used.

[Second Embodiment]

A continuous press-fit terminal body (hereinafter referred to as "continuous PF terminal body") 32 in which the PF terminals 10 explained in the first embodiment are continuously formed in the wire material will be explained hereinafter as the second embodiment. Here, the same reference numeral will be given to the constitution which is common to the PF terminal of the first embodiment, and the detailed explanation thereof will be omitted.

The continuous PF terminal body 32 is, as shown in FIGS. 8A and 8B, formed so that the plurality of PF terminals 10 of the fist embodiment are continuously formed in an elongated wire material 11A and is in a pre-stage state before the continuous PF terminal body 32 is divided into one respective PF terminals 10 as described in the first embodiment.

At this moment, the continuous PF terminal body 32 is formed as one linear member so that the distal section 12 of one PF terminal and the connecting section 13 of another PF terminal are coupled at their respective ends. The portion where the distal section 12 and the connecting section 13 are coupled constitutes a coupled portion 25. The coupled portion 25, since portions of tapers 12*a* and 13*a* formed at the distal section 12 and the connecting section 13 are coupled, is thus formed with a narrowed section 26 at its middle portion. Further, this narrowed section 26 is the portion to be twisted and cut when the PF terminals 10 are divided into the respective members. By dividing so as to twist and cut, generation of burrs at the cutting plane cased by shearing can be inhibited (refer FIGS. 8C to 8E). By thus forming the continuous PF terminal body 32 of one wire material in which the PF terminals 10 described in the first embodiment are formed, the plurality of PF terminals 10 are easily handled when they are transferred, conveyed, and brought in etc.

Figure 9A:
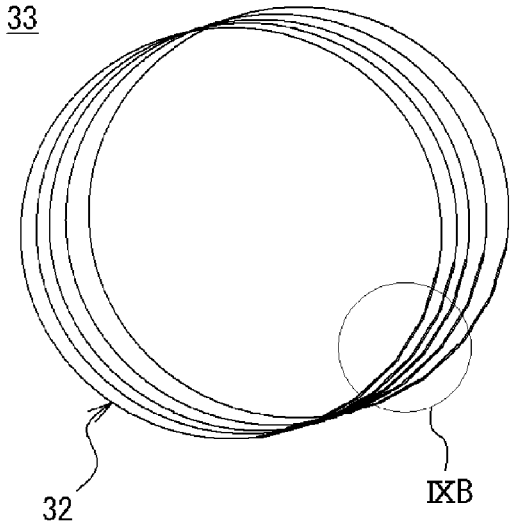
FIG. 9A shows a perspective view of a winding body of the continuous press-fit terminal body.
Figure 9B:
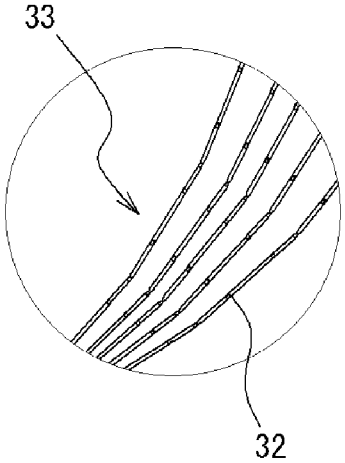
FIG. 9B shows an enlarged view of IXB portion in FIG. 9A.
Figure 9C:
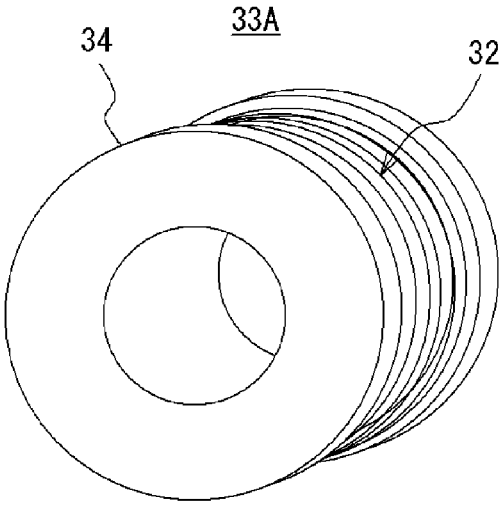
FIG. 9C shows a perspective view of a winding body of the continuous press-fit terminal body wound around a cylindrical member.
Figure 9D:
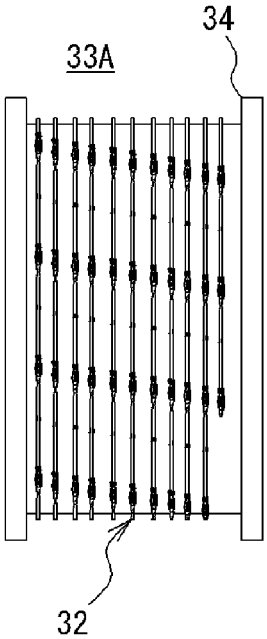
FIG. 9D shows a front view thereof.

The continuous PF terminal body 32 takes a form of a winding body of the continuous PF terminal body 33 wound in a circular shape which has a relatively large diameter as shown in FIGS. 9A and 9B, and also takes a form of winding body of the continuous PF terminal body 33A in which the continuous PF terminal body 32 is wound around a cylindrical member 34 to be a core such as a roll and a bobbin as shown in FIGS. 9C and 9D, thereby it is more easily handled. Further, when the continuous PF terminal body 32 is installed in a press-fitting device for continuously press-fitting the PF terminals into the substrate and the housing, it is possible to install the bobbin etc. to the press-fitting device. Further, the PF terminals can be conveyed and be sold in the state of the winding body of the continuous PF terminal body 33A in which the continuous PF terminal body is wound around the bobbin etc.

EXPLANATION OF LETTERS OR NUMERALS

10, 10B: Press-fit (PF) Terminal
11: Wire Material
11A: Elongated Wire Material
12: Distal section
12*a*: Taper
13: Connecting Section
13*a*: Taper
14: Press-fit (PF) Section
14*a*: Side Surface Section
14*b*: Extended Section
14*c*: Erected Section 14*c*
15: Hole
15*a*: Inner Circumferential Surface
16: Shoulder Portion
17: Shoulder End Portion
18: First Reinforcement Part
19: Second Reinforcement Part
20: Rolled Section
20*a*: Slant
21: Exterior Surface
22: Joining Portion
23: Press-fitting Section
24: Jig
25: Coupled Portion
26: Narrowed Section
27: Connector
28, 28A: Housing
28*a*: Through-hole
29: Substrate
30: Through-hole
31: Unit
32: Continuous Press-fit Terminal Body
33, 33A: Winding Body of the Continuous Press-fit Terminal Body
34: Cylindrical Member
35: Cutting Plane

The invention claimed is:

1. A press-fit terminal made of a wire material of a predetermined length, the press-fit terminal comprising:
a distal section formed at one end of the wire material to be inserted into a substrate;
a connecting section formed at the other end of the wire material to be connected to a complementary terminal; and
a press-fit section formed at the distal section side of the wire material to be press-fitted into a through-hole formed in the substrate; wherein
the press-fit section is formed at the central part thereof a hole vertically elongated along an axis direction of the wire material;
the hole is formed with an extending section extendedly formed toward the inside of the hole along the inner circumferential surface of the hole; and the extending section is formed at the end thereof with an erected section in an intersecting direction about the axis direction of the wire material, the erected section being formed so as to protrude and encircle the hole with a predetermined height.

2. The press-fit terminal according to claim 1, wherein
the press-fit section is formed so that the thickness of the inner circumferential surface become thinner toward the inside of the hole, and
the end of the inner circumferential surface where the thickness thereof is formed to be thin is formed with the extending section and the erected section.

3. The press-fit terminal according to claim 1, wherein
the press-fit section is formed with a shoulder portion at a connecting section side thereof, and
the shoulder portion is provided with a shoulder end portion formed in a size which is able to be pressed by a jig and so as to adjoin the connecting section side of the press-fit section.

4. The press-fit terminal according to claim 3, wherein
the shoulder portion is formed with a reinforcement part along the axis direction of the wire material.

5. The press-fit terminal according to claim 4, wherein
the reinforcement part is formed in a projected shape extending along the axis direction of the wire material.

6. The press-fit terminal according to claim 5, wherein
the shoulder portion is formed with another reinforcement part extending from an end of a laterally protruded portion of the wire material in a direction orthogonal to the lateral direction.

7. The press-fit terminal according to claim 4, wherein
the reinforcement part is formed so as to reach the joining portion from the shoulder portion.

8. The press-fit terminal according to claim 3, wherein
a joining portion for joining the shoulder portion with the press-fit section is integrally formed with the shoulder portion and the press-fit section between the shoulder portion and the press-fit section.

9. The press-fit terminal according to claim 1, wherein
the distal section and the connecting section are formed with tapers tapering off towards ends thereof, and
an end surface of the distal end and an end surface of the connecting section have cross sections which are twisted and cut off.

10. A connector comprising:
a housing formed of insulated material with a plurality of openings; and
press-fit terminals made of a wire material of a predetermined length are installed into the plurality of openings; wherein the respective press-fit terminal includes:
a distal section formed at one end of the wire material to be inserted into a substrate;
a connecting section formed at the other end of the wire material to be connected to a complementary terminal; and
a press-fit section formed at the distal section side of the wire material to be press-fitted into a through-hole formed in the substrate; wherein the press-fit section is formed at the central part thereof a hole vertically elongated along an axis direction of the wire material;

the hole is formed with an extending section extendedly formed toward the inside of the hole along the inner circumferential surface of the hole; and the extending section is formed at the end thereof with an erected section in an intersecting direction about the axis direction of the wire material, the erected section being formed so as to protrude and encircle the hole with a predetermined height.

11. A continuous press-fit terminal body comprising:

a plurality of press-fit terminals being continuously formed in a wire material, the respective press-fit terminal including:

a distal section formed at one end of the wire material to be inserted into a substrate;

a connecting section formed at the other end of the wire material to be connected to a complementary terminal; and a press-fit section formed at the distal section side of the wire material to be press-fitted into a through-hole formed in the substrate; wherein the press-fit section is formed at the central part thereof a hole vertically elongated along an axis direction of the wire material;

the hole is formed with an extending section extendedly formed toward the inside of the hole along the inner circumferential surface of the hole; and the extending section is formed at the end thereof with an erected section in an intersecting direction about the axis direction of the wire material, the erected section being formed so as to protrude and encircle the hole with a predetermined height; and the distal section of one press-fit terminal and the connecting section of another press-fit terminal are coupled together.

12. A winding body comprising:

a plurality of press-fit terminals being continuously formed in a wire material and wound in a circular shape, the respective press-fit terminal including:

a distal section formed at one end of the wire material to be inserted into a substrate;

a connecting section formed at the other end of the wire material to be connected to a complementary terminal; and a press-fit section formed at the distal section side of the wire material to be press-fitted into a through-hole formed in the substrate; wherein the press-fit section is formed at the central part thereof a hole vertically elongated along an axis direction of the wire material;

the hole is formed with an extending section extendedly formed toward the inside of the hole along the inner circumferential surface of the hole; and the extending section is formed at the end thereof with an erected section in an intersecting direction about the axis direction of the wire material, the erected section being formed so as to protrude and encircle the hole with a predetermined height; and the distal section of one press-fit terminal and the connecting section of another press-fit terminal are coupled together.

* * * * *